United States Patent [19]

Ledermann

[11] Patent Number: 4,945,613

[45] Date of Patent: Aug. 7, 1990

[54] CLOTHES-PIN

[76] Inventor: Hugo Ledermann, Schlösslistrasse 16, 6030 Ebikon, Switzerland

[21] Appl. No.: 284,712

[22] Filed: Dec. 14, 1988

[30] Foreign Application Priority Data

Dec. 16, 1987 [CH] Switzerland ..... 4928/87

[51] Int. Cl.[5] ..... A44B 21/00

[52] U.S. Cl. ..... 24/501; 24/511

[58] Field of Search ..... 24/566, 500, 501, 507, 24/508, 511, 510, 509, 67.3, 67.5, 67.7

[56] References Cited

U.S. PATENT DOCUMENTS

| | | | |
|---|---|---|---|
| 157,475 | 12/1874 | Johnson | 24/511 |
| 166,160 | 7/1875 | Topping | 24/501 |
| 2,782,482 | 2/1957 | Baril et al. | 24/501 |
| 2,920,365 | 1/1960 | Colangelo . | |
| 2,922,209 | 1/1960 | Longhi . | |
| 3,135,034 | 6/1964 | Fauteux | 24/507 X |
| 4,145,793 | 3/1979 | Berlet | 24/501 |

FOREIGN PATENT DOCUMENTS

| | | | |
|---|---|---|---|
| 69934 | 9/1949 | Denmark | 24/501 |
| 963660 | 3/1948 | France . | |
| 1456057 | 9/1965 | France . | |
| 278907 | 2/1950 | Switzerland . | |
| 545877 | 3/1973 | Switzerland . | |
| 607226 | 11/1945 | United Kingdom . | |
| 595158 | 11/1947 | United Kingdom . | |
| 610897 | 10/1948 | United Kingdom | 24/508 |
| 651186 | 3/1951 | United Kingdom | 24/507 |

*Primary Examiner*—James R. Brittain

*Attorney, Agent, or Firm*—Browdy and Neimark

[57] ABSTRACT

The clothes-pin consists of a spring element and two identically formed members having a clamping section and a handle section. The spring element connects the two members in that on the one hand the end engages the blind hole and on the other hand it surrounds the support position.

The clothes-pin is remarkable by its simple design and assembly.

1 Claim, 2 Drawing Sheets

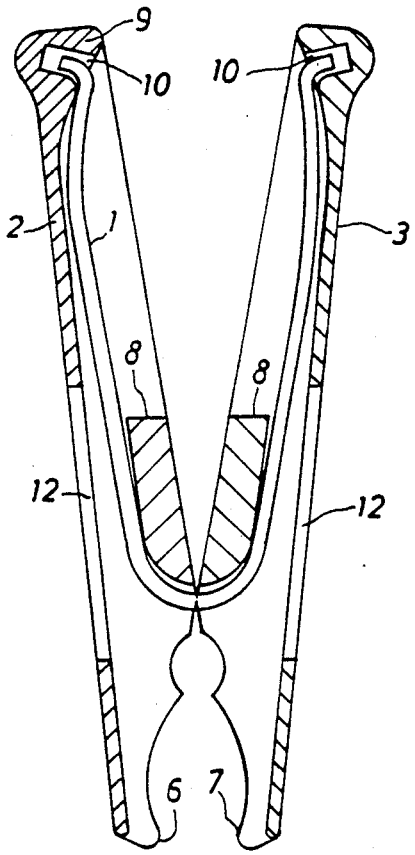
Fig. 4
Fig. 6
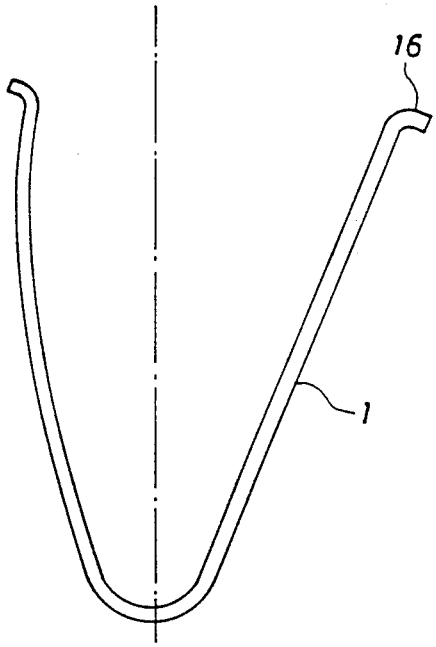

CLOTHES-PIN

BACKGROUND OF THE INVENTION

1. Field of the Invention

The present invention relates to a clothes-pin including two members and a spring element.

2. Description of the Prior Art

The clothes-pins on the market commonly consist of two members and one spring element which connects the members to each other. For one embodiment, the spring element is a helically-shaped spring having tangentially protruding ends warped oppositely. The exposed ends cause iron-moulds on clothes when becoming rusty. Furthermore, lingerie can be clamped between the members and the ends of the spring.

For clothes-pins, the helical spring part of which performs the tilting motion, the members tend to fall out.

In order to avoid the mentioned drawbacks, different solutions have been proposed, which proposals should eliminate one or the other drawback or both drawbacks. This has resulted partly in complicated forms, causing appropriate extrusion dies and further the use of expensive plastic material. In order to avoid the use of high quality plastic material, properly protected leaf-springs have been used to eliminate any contact with clothes.

Clothes-pins are extremely cheap bulk-goods. The production costs are determined by the costs of material, the costs and service life of the device suitable for the forming, the costs for the energy expended for the mounting and the costs for ready packaging. Moreover, the clothes-pin must give a good account of its durability when used. Plastics change their properties under the influence of heat, humidity and mechanical wear and tear in a disadvantageous manner.

SUMMARY OF THE INVENTION

An object of the present invention is to provide a clothes-pin comprising two members and a spring element connecting the members to each other, whereby the disadvantages of creating iron-moulds and the fall out are removed.

A further object of the present invention is to provide a clothes-pin comprising two members and a spring element connecting the members to each other, said spring element is a V-shaped spring wire whereby said holding portion extends rectangularly outwards with respect to the legs of the springs wire, and each member has a groove on the inside, which groove extends from the clamping section to the recess in the holding section, and which is closed inwards by said support portion, and is open outwards by a notch, whereby the spring wire is insertable between said member when assembling the clothes-pin.

It is of advantage that the spring wire is deprived of contact with the clothes and the remainder of possible detergent contained in the clothes, which detergent causes the corrosion. The jamming of lingerie between sections of the spring wire and the members can be excluded and a fall out of the members is avoided by the spring wire fixed in the groove.

While some of the more salient features, characteristics, and the like, of the above invention have been pointed out, others will become apparent from the following disclosure.

BRIEF DESCRIPTION OF THE DRAWINGS

The present invention will be more fully understood by reference to the following detailed description thereof, when read in conjunction with the attached drawings, wherein FIG. 4 is a longitudinal section of the clothes-pin shown in FIG. 1, FIG. 6 is a front elevation of a preferred embodiment of the spring element in accordance with the invention.

DESCRIPTION OF THE PREFERRED EMBODIMENT

Figure 1:
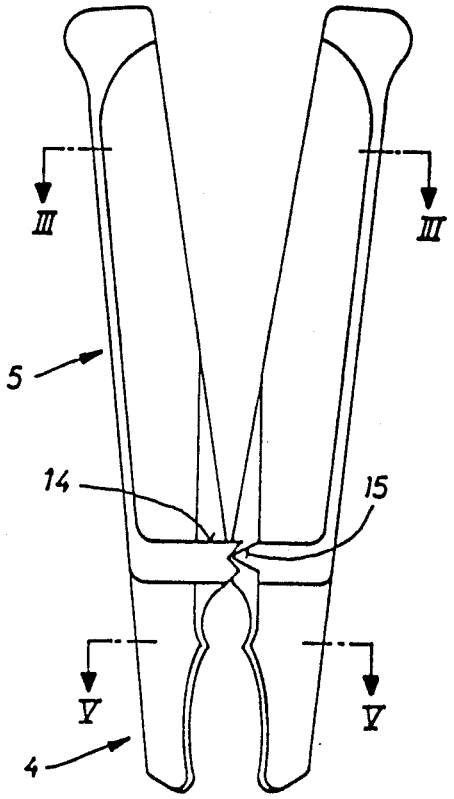
FIG. 1 is a front elevation of a preferred embodiment of the clothes-pin in accordance with the invention.
Figure 2:
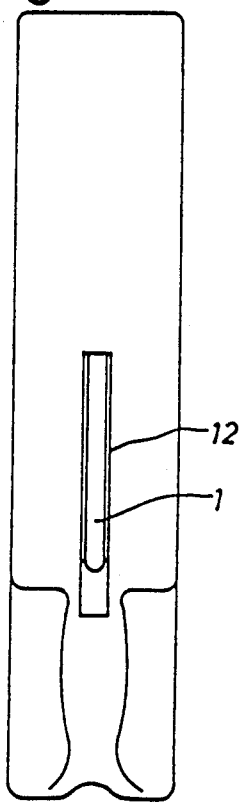
FIG. 2 is a side elevation of the clothes-pin shown in FIG. 1.
Figure 3:
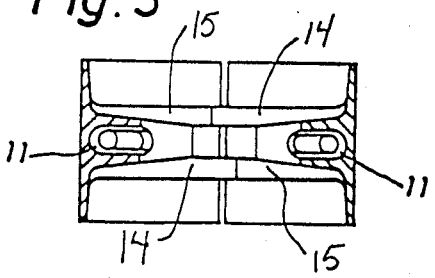
FIG. 3 is a section taken along the line III—III in FIG. 1.
Figure 5:
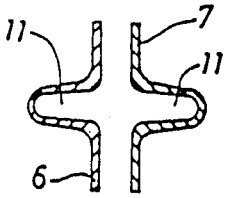
FIG. 5 is a section taken along the line V—V in FIG. 1.

FIGS. 1 to 6 show an embodiment of the inventive clothes-pin, which merely consists of a spring element 1 and two members 2, 3 which are identically formed.

The members 2,3 have a clamping section 4 and a handle section 5, the border line of which coincides with a swivel line. The clamping section 4 has a form of cross-section shown in FIG. 5 and two sections 6,7 forming the clamping jaws of the clothes-pin. A portion 8 is formed inside of the handle section 5, which portion forms a support portion for the spring element 1. A solid portion 9 is provided on the free end of the handle section 5. A blind hole 10 is formed in the solid portion 9. Each member 2,3 has a groove 11 extending from the clamping section 4 to the handle section 5, at the free end of which said groove tapers off and establishes the solid portion 9. Further, each member 2,3 includes a notch 12. As is obvious from FIG. 4, on the one side the groove 10 is closed inwardly by the portion 8 and on the other side the groove is opened outwards by the notch 12. As obvious from FIG. 1, the hinge of the clothes-pin is formed by a first portion 14 having a V-shaped notch and a second portion 15 having a V-shaped projection. Each member 2,3 is provided with said first and second projection 14, 15.

The spring element 1 is V-shaped and consists of spring wire. The end of the legs have a bent portion 16. FIG. 6 shows one leg of the spring element in an unloaded condition and the other leg of the spring element in a partly loaded condition, as shown in FIG. 4.

In the ready to use clothes-pin the portion 16 of the spring element 1 protrudes into the blind holes 10 and the spring element 1 surrounds the support portions 8. Thereby, the members 2,3 are held together and are pivotable about the hinge axle established by the first and the second portion 14,15.

The assembly of the clothes-pin is very easy and can be performed mechanically. The insertion of the spring element is caused at approximate maximum opening of the clamping sections by inserting the spring element into the notches until the bent portions on the free ends of the spring engage the blind holes.

I claim:

1. A clothespin comprising two members having a gripping section, a clamping section, and a pivot portion intermediate said gripping and clamping sections;

a spring element connecting said members such that said members are pivotable relative to each other;

each member including a recess on an inside of said gripping section, a groove on an inside portion of said member, which groove extends from said clamping section to said recess in said gripping section, and a support portion integrally formed on the inside of said gripping section and bridging said groove to form a support for said spring element;

said spring element comprising an essentially V-shaped spring wire having two legs, a base portion of said V-shaped spring wire connecting said legs, and an end portion on a free end of each of said legs;

said spring element being received in said recesses by said end portions on the free end of each of said legs;

said legs disposed within said grooves, and said base of said V-shaped spring wire wrapped, at least partly, around said support portions forming said support for said spring elements;

said pivot portion including a first section having a V-shaped notch, and a second section having a V-shaped projection, said first and second sections being provided on both sides of said groove.

* * * * *